US008038505B2

(12) United States Patent
Huang

(10) Patent No.: US 8,038,505 B2
(45) Date of Patent: Oct. 18, 2011

(54) BRASSIERE CUP AND PAD STRUCTURE

(75) Inventor: Lin-Hsiang Huang, Jente Township, Tainan County (TW)

(73) Assignee: Perfect World Co., Ltd., Tainan County (TW)

( * ) Notice: Subject to any disclaimer, the term of this patent is extended or adjusted under 35 U.S.C. 154(b) by 203 days.

(21) Appl. No.: 12/453,801

(22) Filed: May 22, 2009

(65) Prior Publication Data

US 2010/0015887 A1 Jan. 21, 2010

(30) Foreign Application Priority Data

Jul. 15, 2008 (TW) ..... 97212605 U

(51) Int. Cl.
*A41C 3/00* (2006.01)

(52) U.S. Cl. ..... 450/39; 450/37

(58) Field of Classification Search ..... 450/37–39, 450/54–58; 2/267, 268
See application file for complete search history.

(56) References Cited

U.S. PATENT DOCUMENTS 5,962,349 A * 10/1999 Mizukami et al. ..... 442/311
6,824,445 B2 * 11/2004 Oneyear et al. ..... 450/70

* cited by examiner

*Primary Examiner* — Gloria Hale
(74) *Attorney, Agent, or Firm* — Rosenberg, Klein & Lee

(57) ABSTRACT

A brassiere cup and pad structure is revealed. The brassiere cup and pad structure consists of two outer linings made from polypropylene and an inner padding made from the same material-polypropylene. By the polypropylene with low melting point, the dye degradation on the outer lining caused by high temperature during foaming processes can be avoided. Thus the amount of defective products in which the outer lining have spots resulted from degraded dyes is reduced. Moreover, the shortcoming of general inner padding made from foam that is easy to turn yellow over time is improved effectively.

4 Claims, 6 Drawing Sheets

BRASSIERE CUP AND PAD STRUCTURE

BACKGROUND OF THE INVENTION

1. Fields of the Invention

The present invention relates to a brassiere cup and pad structure, especially to an inner padding and outer linings of brassieres made from polypropylene with low melting point. Thereby the outer linings will not have spots caused by degradation of dyes at high temperature forming and the shortcoming of general inner padding made from foam that is easy to turn yellow over time is improved effectively.

2. Descriptions of Related Art

Along with improvement of life quality, people have higher requirements of various commodities. For example, the brassiere wore by females is not only simply with basic functions such as protection of female breasts or keeping breast shape. Moreover, the brassiere should be with higher wearing comfort and enhancement of breast appearance as well as shape.

In order to make the female chest shape look more beautiful and aesthetic, now underwear manufacturers develops brassiere cups, brassiere pads to enhance and improve breast shape. Refer to FIG. 7, the brassiere cups and pads available now are mainly composed of two outer linings (3) made from polyester-based non-woven fabric and an inner padding (4) made from polyurethane foam clipped between the two outer linings (3). An adhesive such as glue is sprayed between the two outer linings (3) and the inner padding (4) for adhesion. Then the device is hot embossed by a high temperature mold whose temperature ranging from 180° C. to 210° C. to form products with required shapes such as brassiere cups or brassiere pads.

In order to make the brassiere cup and pad structure become more beautiful and aesthetic, or have colors similar to the brassieres, the two outer linings are dyed. However, chemical changes occur in dyes at high temperature so that red and blue spots are produced. The defects caused by dye spots are not acceptable by clients and the products become defective goods. This leads to production losses.

Besides, the brassiere cup and pad structure formed by the two outer linings made from polyester-based non-woven fabric and the inner padding made from polyurethane foam is sprayed with adhesives such as glue before the hot embossing so as to secure the firmness of the connection between the outer linings and the inner padding made from different materials. The step of coating the adhesive not only takes time but also increase production cost. In view of global environmental protection, the improper use of adhesives is a waste of resource. Moreover, after high temperature processing and long term contact with air, the inner foam padding easily turns yellow that has negative effects on the beauty of brassiere's appearance.

Thus there is a need to provide a novel brassiere cup and pad structure that overcomes shortcomings of the brassiere cup and pad structure available now such as spots on surfaces, use of adhesives and the foam of the inner padding that turns yellow easily as it ages.

SUMMARY OF THE INVENTION

Therefore it is a primary object of the present invention to provide a brassiere cup and pad structure that prevents spots of degraded dyes from appearing on the outer linings caused by high temperature during forming processes and overcomes the shortcoming of general inner padding made from foam that is easy to turn yellow over time. Moreover, there is no need to use adhesives by such design. Therefore, the loss cost is down and the wearing comfort of brassieres is improved.

In order to achieve above object, a brassiere cup and pad structure of the present invention includes two outer linings made from polypropylene and an inner padding also made polypropylene clipped between the two outer linings. By the polypropylene with low melting point, the dye degradation on the outer lining caused by high temperature during foaming processes can be avoided effectively and the amount of defective products with spots on outer linings is reduced. Moreover, the shortcoming of general inner padding made from foam that is easy to turn yellow over time is overcome completely.

Furthermore, there is no need to use adhesives that connects the inner padding with outer linings made from different materials because the inner padding and outer linings are both made from polypropylene. Thus the loss cost is reduced.

In addition, by water repellency and good air permeability of polypropylene, the sweat and humidity from human bodies are dispersed into the air so that users feel more comfortable while wearing the brassieres.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 1:
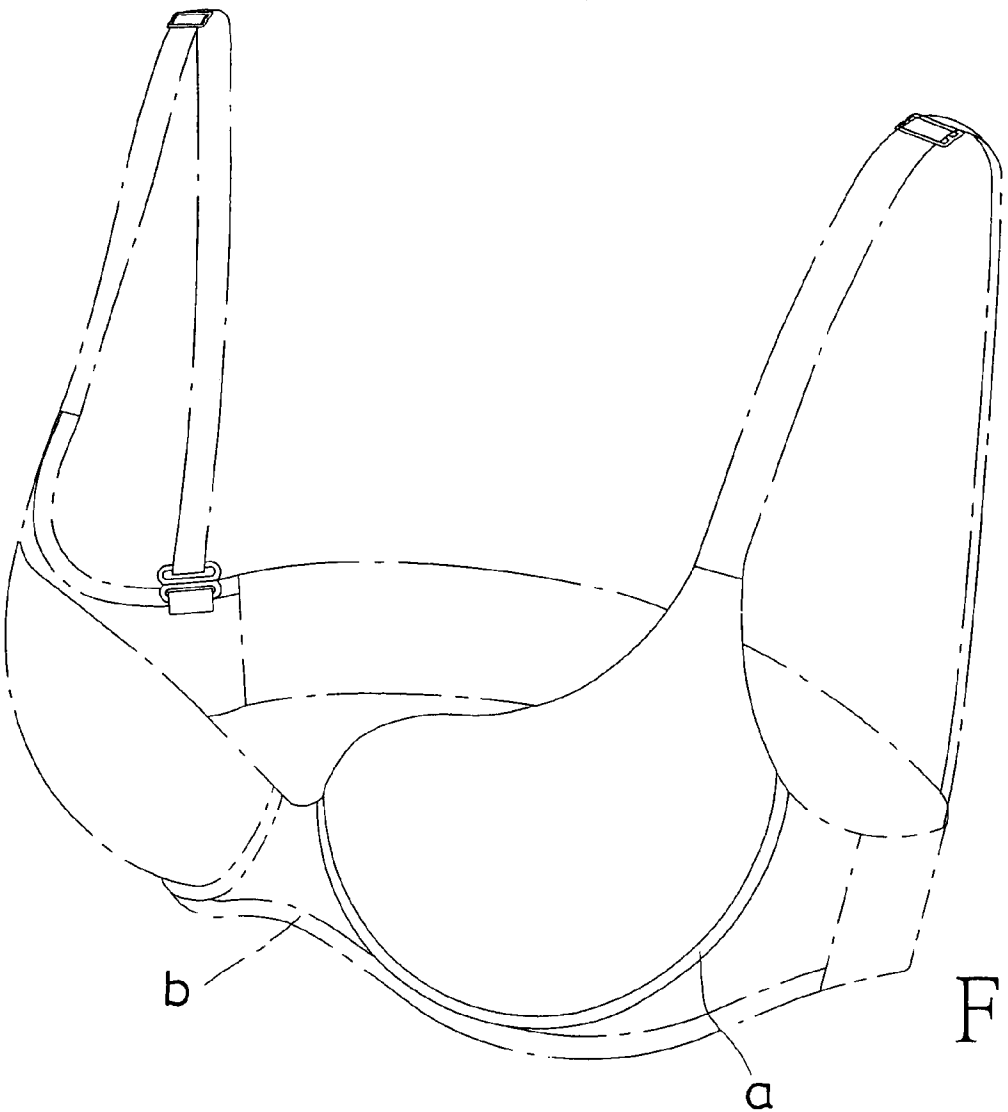
FIG. 1 is a perspective view of an embodiment of a brassiere according to the present invention.
Figure 2:
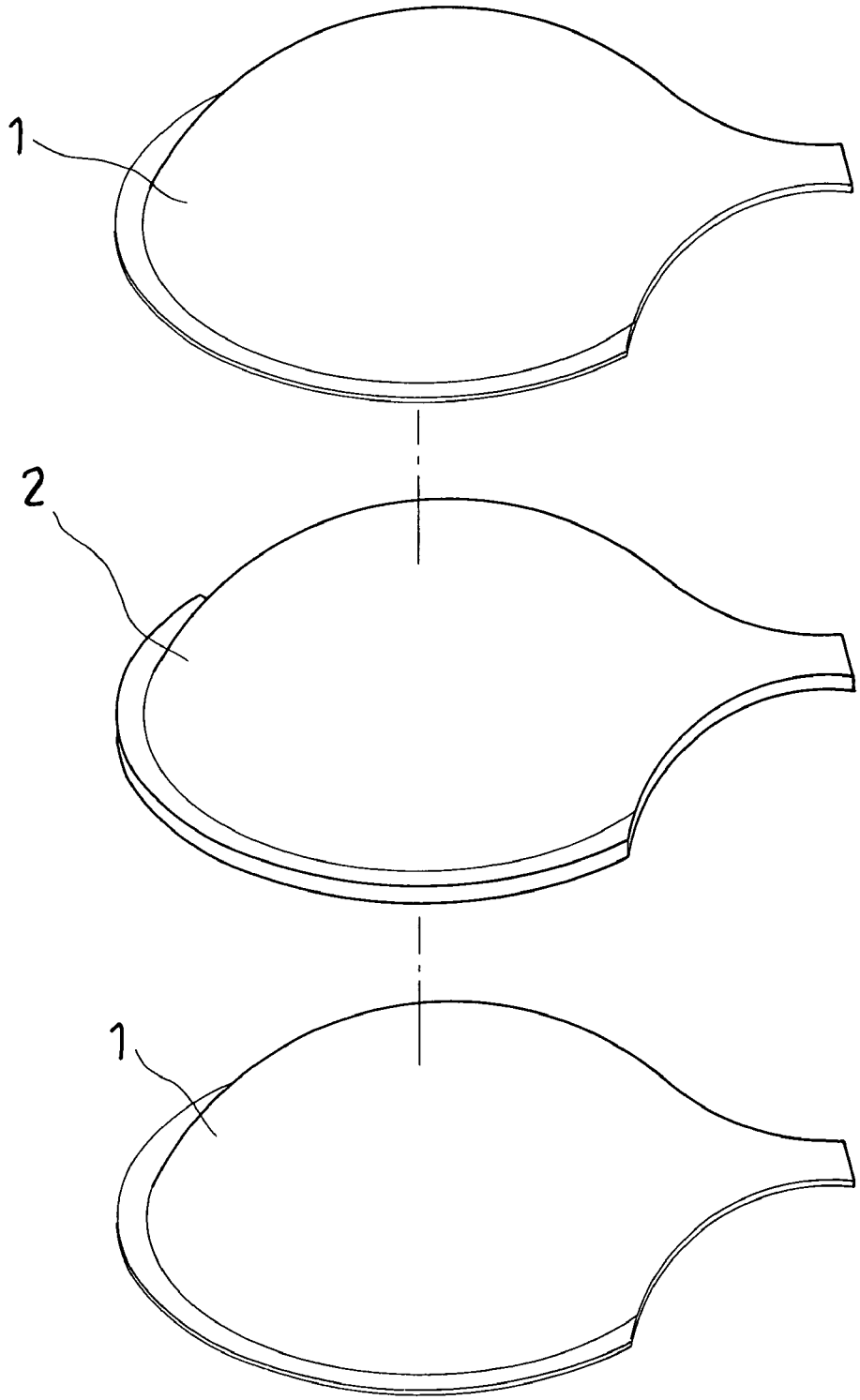
FIG. 2 is an explosive view of an embodiment of a brassiere cup according to the present invention.
Figure 3:
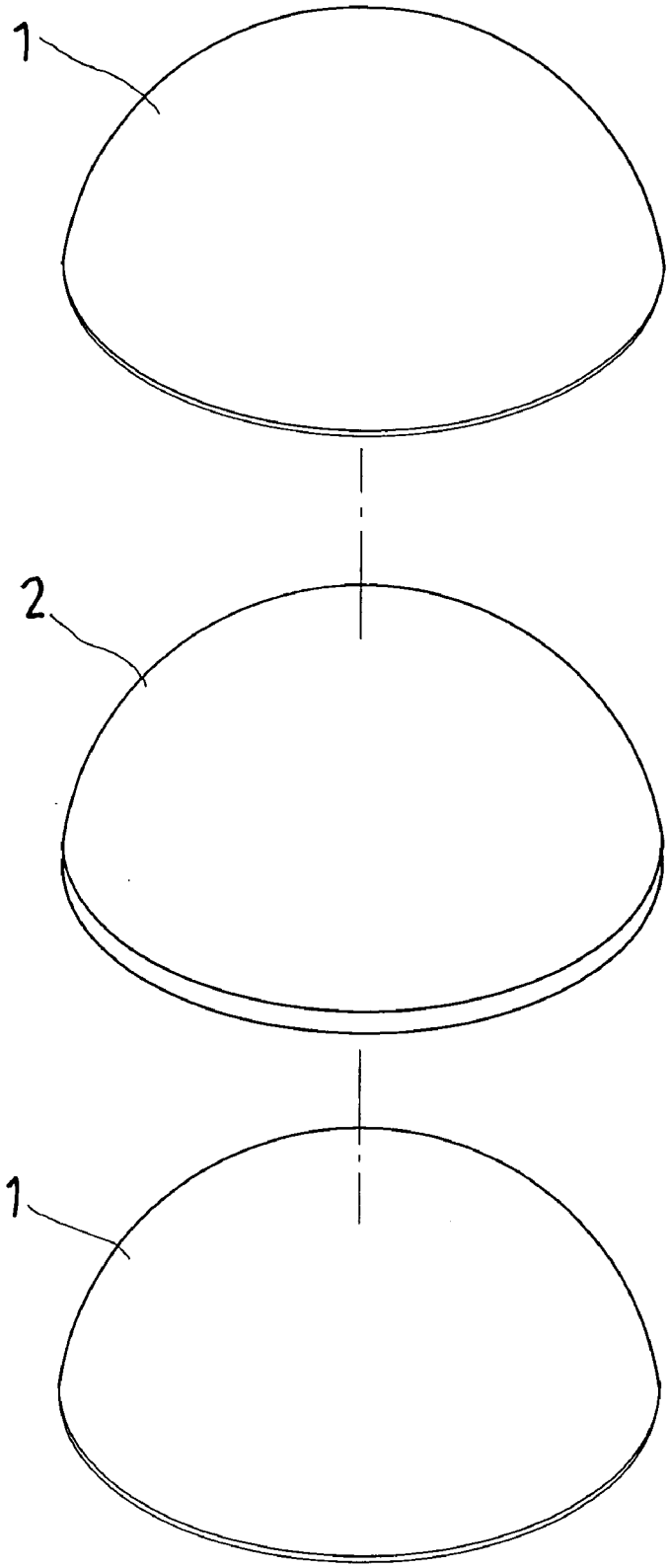
FIG. 3 is an explosive view of an embodiment of a brassiere pad according to the present invention.
Figure 4:
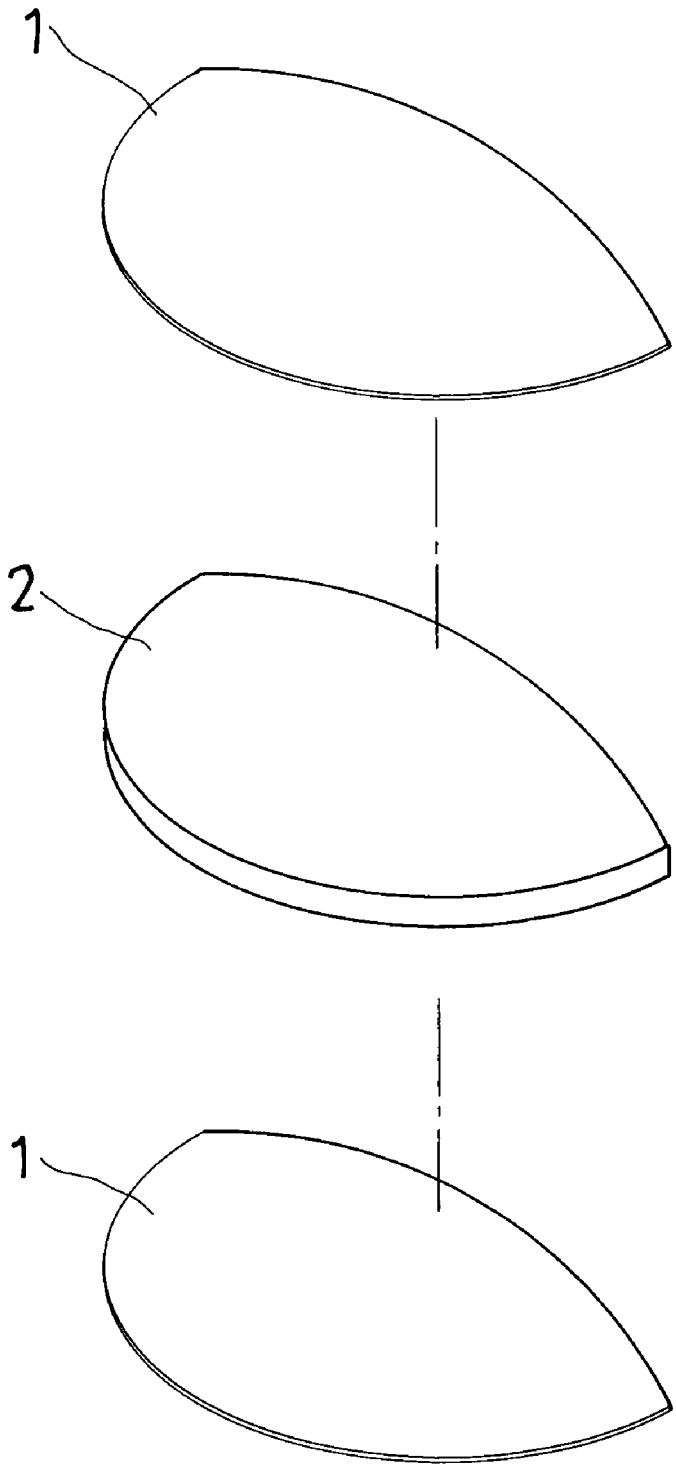
FIG. 4 is an explosive view of another embodiment of a brassiere pad according to the present invention.

At first, refer to FIG. 1 & FIG. 2, a brassiere cup and pad structure (a) of the present invention is used in an inner surface of a brassiere (b) for improvement of the appearance of breasts. The brassiere cup and pad structure (a) includes two outer linings (1) made from polypropylene and an inner padding (2) made from the same material clipped therebetween. The forming steps are as followings:

A. heating of the inner padding: the inner padding (2) that is the formed or molded cap (as shown in FIG. 2) or pad (as shown in FIG. 3 & FIG. 4) with preset shape is put into an oven whose temperature is set at 90° C.~110° C. The material of the inner padding (2) is non-woven fabric made from polypropylene. Then both inner and outer surfaces of the inner padding (2) are heated until fiber on the inner and the outer surfaces of the inner padding (2) made from polypropylene non-woven fabric with low melting point is melt.

B. heating of the outer lining: two outer linings (1) with preset shape of brassiere cup or pad are respectively put into an oven in which the temperature is set at 90° C.~110° C. And only a single surface of the outer lining (1) passes the oven so that fiber on the single surface of the outer lining (1) made from polypropylene knitted fabric is heated and melted.

C. connecting the inner padding with the outer lining: the heated and melted surface of the outer lining (1) is put on the outer surface of the inner padding (2) to be embossed and pressed so that the outer surface of the inner padding (2) adheres to the outer lining (1). Next the heated and melted surface of the other outer lining (1) is set on the inner surface of the inner padding (2) to be embossed and pressed so as to press the other outer lining (1) on the inner surface of the inner padding (2). Thereby the inner padding (2) made from non-woven fabric is adhered with the outer lining (1) made from knitted fabric on a single side or double sides.

D. forming: the connected inner padding (2) and the outer lining (1) is set into a forming machine so as to produce products brassiere cup and pad.

Thereby, the hot embossing temperature is reduced by use of low melting point polypropylene. Thus the outer lining (1) dyed by various dyes is not affected by high temperature to have read or blue spots on a surface thereof. Therefore, the defective rate of products is effectively reduced.

Moreover, after being melted, the short fiber polypropylene has some sort of adhesive effect so that the inner padding (2) and the outer linings (1) are easily adhered to and integrated with each other. There is no need to use adhesives such as spray adhesive for mounting. Thereby the waste caused by improper use of adhesives is reduced and the loss cost is down.

Furthermore, the brassiere cup and pad structure made from polypropylene has features of water repellency and good air permeability to disperse body heat and humidity. Thus the brassiere cup and pad will not be bathed in sweat and humidity that causes skin discomfort.

Figure 5:
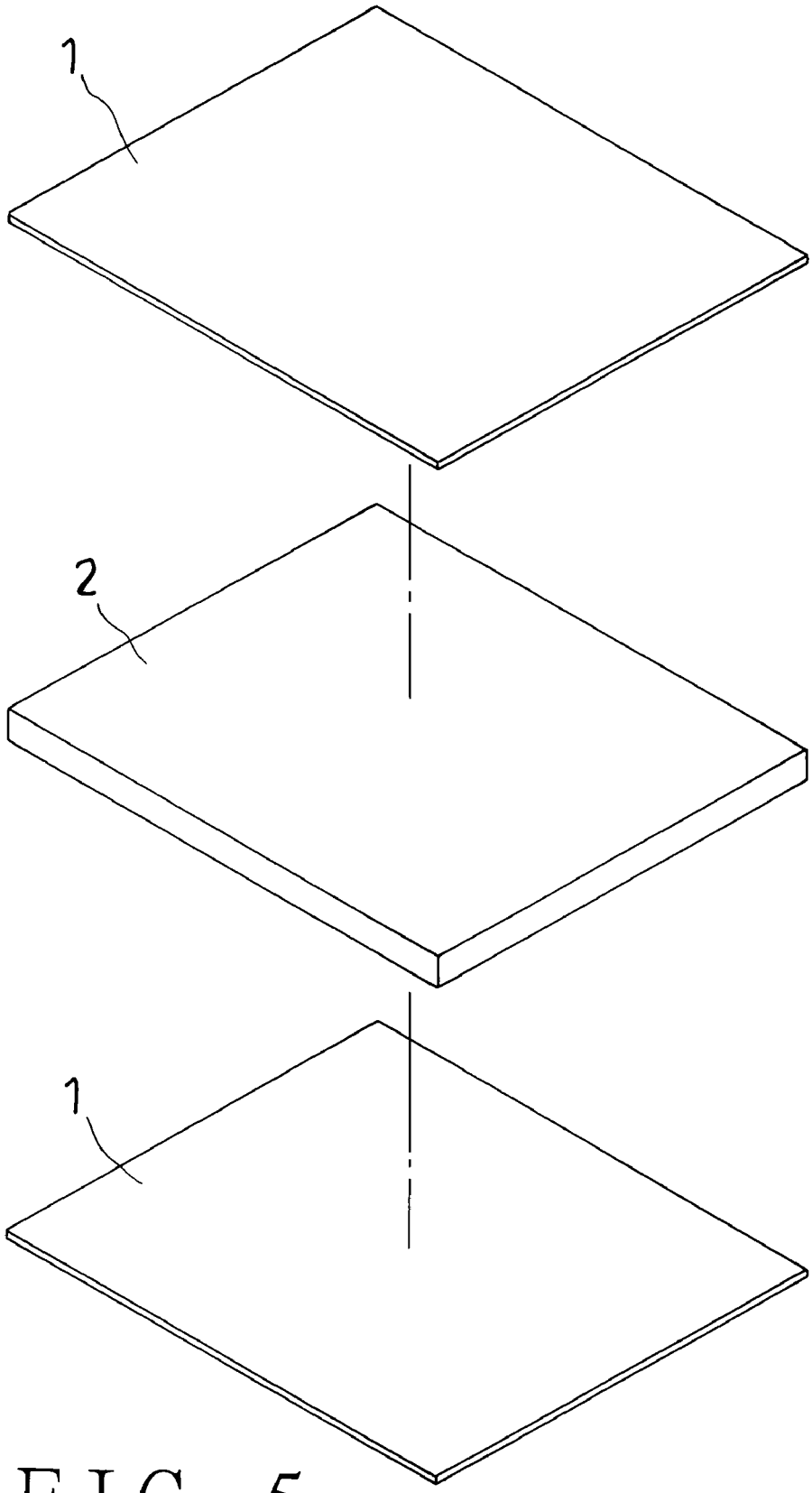
FIG. 5 is an explosive view of a further embodiment according to the present invention.
Figure 7:
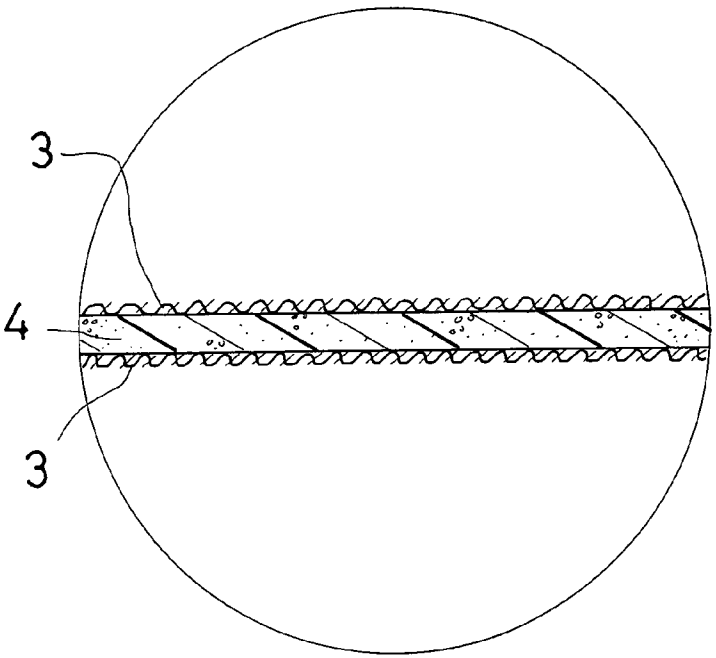
FIG. 7 (PRIOR ART)
FIG. 7 is a cross sectional view of a prior art.
Figure 6:
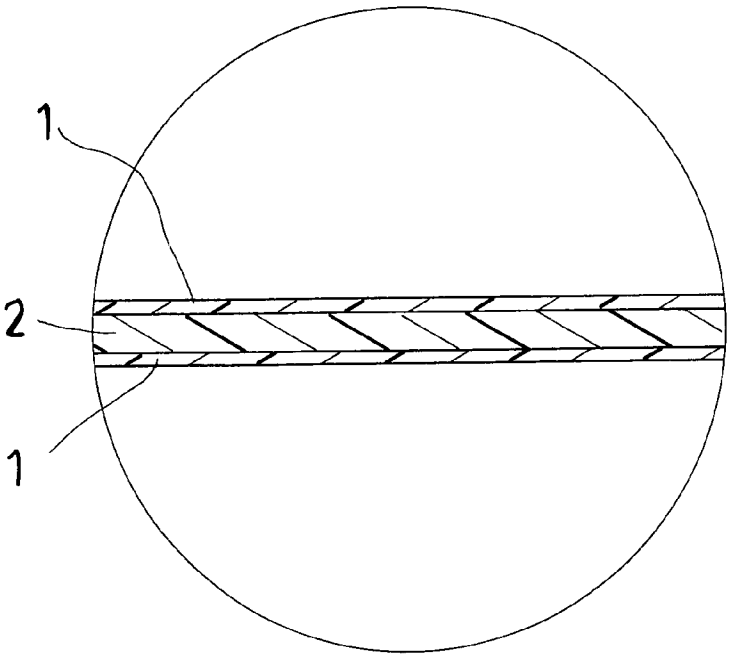
FIG. 6 is a cross sectional view of an embodiment according to the present invention.

In addition, refer to FIG. 5 & FIG. 6, a further embodiment is disclosed. The manufacturing method of the device includes the following steps:

A. overlapping an inner padding and outer linings: the inner padding (2) made from non-woven polypropylene is set between two outer linings (1) made from polypropylene knitted fabric.

B. heating to melt: then the overlapped inner padding (2) and the outer linings (1) are put into an oven whose temperature is set at 90° C.~110° C. so that fabric surfaces of the overlapped inner padding (2) and the outer linings (1) are melt and adhered to each other.

C. embossing and forming: next, the melt and attached inner padding (2) and the outer linings (1) are further embossed by molds to form preset products such as brassiere cups and brassiere pads. Thus the inner padding (2) and the outer linings (1) are integrated with each other to form final products such as brassiere cups and brassiere pads.

From above structure and embodiments, it is learned that the brassiere cup and pad structure of the present invention has following advantages:

1. The material for the brassiere cups and pads is polypropylene with low melting point and low temperature ranging from 90° C. to 110° C., compared with melting temperature of conventional material ranging from 180° C. to 210° C., is used to heat and melt the non-woven fabric or knitted fabric made by polypropylene so as to be embossed into brassiere cups and pads. Thereby the shortcoming of brassiere cups and pads made from materials with high melting point available now that is easy to have defective products with spots caused by dye degradation during hot embossing processes is overcome effectively because that polypropylene has features of low melting point and minimum changes in colors.

2. The material of the present device is polypropylene. Thus the disadvantage of foam that turns yellow easily after high temperature processing as well as long term contact with air and destroys the beauty of brassiere's appearance can be overcome completely.

3. Both the inner padding and outer linings of the brassiere cups and pads are made from polypropylene. Thus there is no need to use adhesives before the hot embossing so as to secure the firmness of the connection between the outer linings and the inner padding made from different materials. And the loss cost is reduced.

4. The brassiere cup and pad structure of the present invention is made from polypropylene. Due to water repellency and good air permeability of polypropylene, the sweat and heat from human bodies are dispersed into the air. The skin discomfort caused by the brassiere cup and pad bathed in sweat and humidity is minimized.

5. The polypropylene is a soft material so that users feel more comfortable with the brassieres. Moreover, after being formed into brassiere cups and pads, the brassiere cup and pad structure is not easily deformed due to stiffness of polypropylene.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A brassiere cup and pad structure comprising:

at least one outer lining made from polypropylene; and an inner padding made from polypropylene and adhered to the outer lining by low temperature bonding to form a water repellant and air permeable brassiere cup.

2. A brassiere cup and pad structure comprising:

a first and second outer lining each made from polypropylene; and an inner padding made from polypropylene, the inner padding being disposed between the first and second outer linings and joined thereto by low temperature bonding to form a water repellant and air permeable brassiere cup.

3. The device as claimed in claim 1, wherein the outer lining is a polypropylene knitted fabric and the inner padding is a non-woven polypropylene.

4. The device as claimed in claim 2, wherein the first outer lining and the second outer lining are each a polypropylene knitted fabric and the inner padding is non-woven polypropylene.

* * * * *